US007385480B2

(12) United States Patent
Fitzpatrick

(10) Patent No.: US 7,385,480 B2
(45) Date of Patent: Jun. 10, 2008

(54) FIRE FIGHTING APPARATUS

(76) Inventor: Peter J. Fitzpatrick, 37 Ash Grove, Fethard-On-Sea, County Wexford (IE)

( * ) Notice: Subject to any disclaimer, the term of this patent is extended or adjusted under 35 U.S.C. 154(b) by 199 days.

(21) Appl. No.: 10/561,935

(22) PCT Filed: Jun. 24, 2004

(86) PCT No.: PCT/EP2004/006896

§ 371 (c)(1),
(2), (4) Date: Dec. 22, 2005

(87) PCT Pub. No.: WO2005/000414

PCT Pub. Date: Jan. 6, 2005

(65) Prior Publication Data

US 2006/0187000 A1 Aug. 24, 2006

(30) Foreign Application Priority Data

Jun. 26, 2003 (IE) ..... S2003/0471

(51) Int. Cl.
*A62C 37/14* (2006.01)
*G08B 17/00* (2006.01)

(52) U.S. Cl. ..... 340/286.05; 169/58; 340/628

(58) Field of Classification Search ..... 340/288, 340/289, 286.05, 640, 539.26, 539.27, 577–579; 169/73, 46, 47, 51, 54, 56–60, 7, 8, 10, 76
See application file for complete search history.

(56) References Cited

U.S. PATENT DOCUMENTS 1,169,210 A * 1/1916 Walsh ..... 169/57
2,749,993 A * 6/1956 Gregg ..... 169/26
3,040,815 A 6/1962 Pambello
3,486,563 A * 12/1969 Cholin et al. ..... 169/26
3,654,996 A 4/1972 Naglowsky
3,782,475 A * 1/1974 Schmidt ..... 169/50
3,866,687 A * 2/1975 Banner ..... 169/61
4,251,579 A * 2/1981 Lee et al. ..... 428/73

(Continued)

FOREIGN PATENT DOCUMENTS

DE 38 09 754 A 11/1988

(Continued)

*Primary Examiner*—Benjamin C. Lee
*Assistant Examiner*—Jennifer Mehmood
(74) *Attorney, Agent, or Firm*—Botkin & Hall, LLP

(57) ABSTRACT

An apparatus for fighting a fire comprises a suspendible container having a perforated lower surface each of whose perforations is closed by a heat-sensitive membrane rupturable at an elevated temperature. The container contains a fire retardant material which is released upon rupture of the membrane. The apparatus further includes an electric heater adjacent to the membrane and a smoke detector controlling the heater such that upon the detection of smoke, the heater is switched on to rupture the membrane. A second embodiment has at least one further heat-sensitive membrane embedded in the fire retardant material above the first membrane such that a respective layer of fire retardant material lies above each membrane. Thus, upon rupture of the first membrane, the layer of fire retardant material immediately above it is released and the further membrane comes to rest upon the lower surface of the container, the layer of fire retardant material immediately above the further membrane being released only upon subsequent rupture of the further membrane.

9 Claims, 2 Drawing Sheets

U.S. PATENT DOCUMENTS 4,830,116 A * 5/1989 Walden et al. ..... 169/65
4,870,942 A * 10/1989 Shibata et al. ..... 123/676
5,315,292 A 5/1994 Prior
5,425,426 A * 6/1995 Baratov et al. ..... 169/46
5,490,566 A * 2/1996 Purser ..... 169/26
5,518,075 A * 5/1996 Williams ..... 169/59
5,909,776 A * 6/1999 Stewart et al. ..... 169/26
6,136,423 A 10/2000 Fitzpatrick
6,572,948 B1 * 6/2003 Dykhoff ..... 428/76
6,725,941 B2 * 4/2004 Edwards et al. ..... 169/47

FOREIGN PATENT DOCUMENTS

DE 41 02 330 A 8/1992

* cited by examiner

FIRE FIGHTING APPARATUS

BACKGROUND OF THE INVENTION

This invention relates to an apparatus for fighting a fire.

A known apparatus for fighting a fire inside or outside a building includes fire extinguishers containing various chemicals as well as water, and ceiling-mounted water sprinklers. However, most sprinkler heads must sense a temperature of 200 degrees F. or 85 degrees C. before activation occurs, thereby giving the fire time to become extremely hot and, therefore, more difficult to extinguish. Also, what is not destroyed by fire will be destroyed by water in that room and the rooms below and adjacent thereto.

SUMMARY OF THE INVENTION

An object of the present invention is to provide a new fire-fighting apparatus that can be used independently or in conjunction with any of the known fire fighting apparatus, including those mentioned above.

Accordingly, the invention provides an apparatus for fighting a fire. The apparatus includes a suspendible container having a perforated lower surface. Each of the perforations is closed by a heat-sensitive membrane that is capable of rupture at an elevated temperature. The container contains a fire retardant material that is released upon rupture of the membrane. The apparatus includes an electric heater adjacent to the membrane and a smoke detector controlling the heater such that upon the detection of smoke the heater is switched on to rupture the membrane.

There is also provided, as a separate invention, an apparatus for fighting a fire comprising a suspendible container having a perforated lower surface each of whose perforations is closed by a first heat-sensitive membrane which is capable of rupture at an elevated temperature, the container containing a fire retardant material which is released upon rupture of the membrane, the apparatus further including at least one further heat-sensitive membrane embedded in the fire retardant material above the first membrane such that a respective layer of fire retardant material lies above each membrane, whereby upon rupture of the first membrane the layer of fire retardant material immediately above it is released and the further membrane comes to rest upon the lower surface of the container, the layer of fire retardant material immediately above the further membrane being released only upon subsequent rupture of the further membrane.

The invention may be used for fighting and extinguishing fires inside and outside buildings and other structures such as in the home or office, at vehicle service stations or oil rigs, and in tunnels, aircraft or ships.

The invention can be constructed in the form of a ceiling tile or in the form of a novelty or ornament which could decorate the mantelpiece over a fireplace or over a cooker or hob or the like, or over a bed. The apparatus could be affixed in a known manner to the ceiling of an office or a living room or kitchen or closet or even to the inside roof of the housing of a television set or other item of electrical equipment.

BRIEF DESCRIPTION OF THE DRAWINGS

Embodiments of the invention will now be described, by way of example, with reference to the accompanying drawings, in which.

DETAILED DESCRIPTION OF INVENTION

Figure 1:
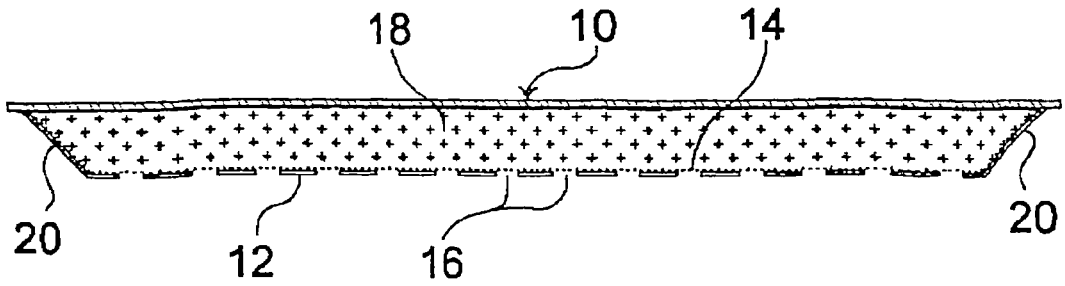
FIG. 1 is a cross-sectional side view of a ceiling tile embodying the invention.
Figure 2:
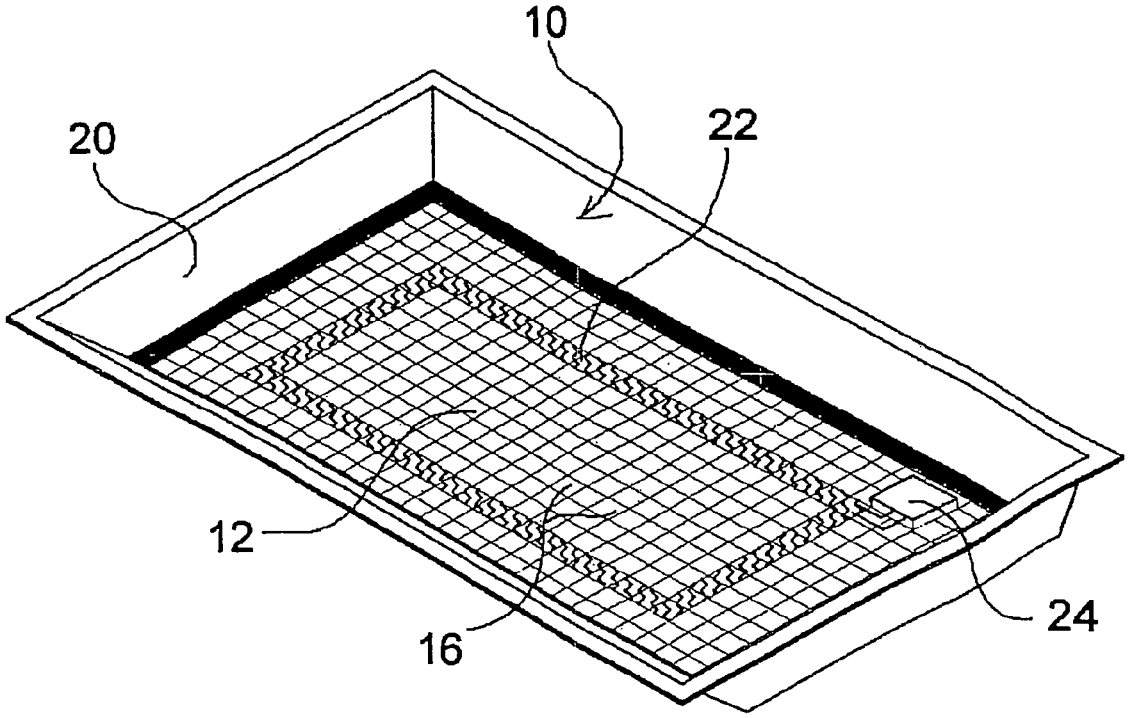
FIG. 2 is a top perspective view of the tile of FIG. 1 omitting the heat-sensitive membrane and fire retardant material contained therein.
Figure 3:
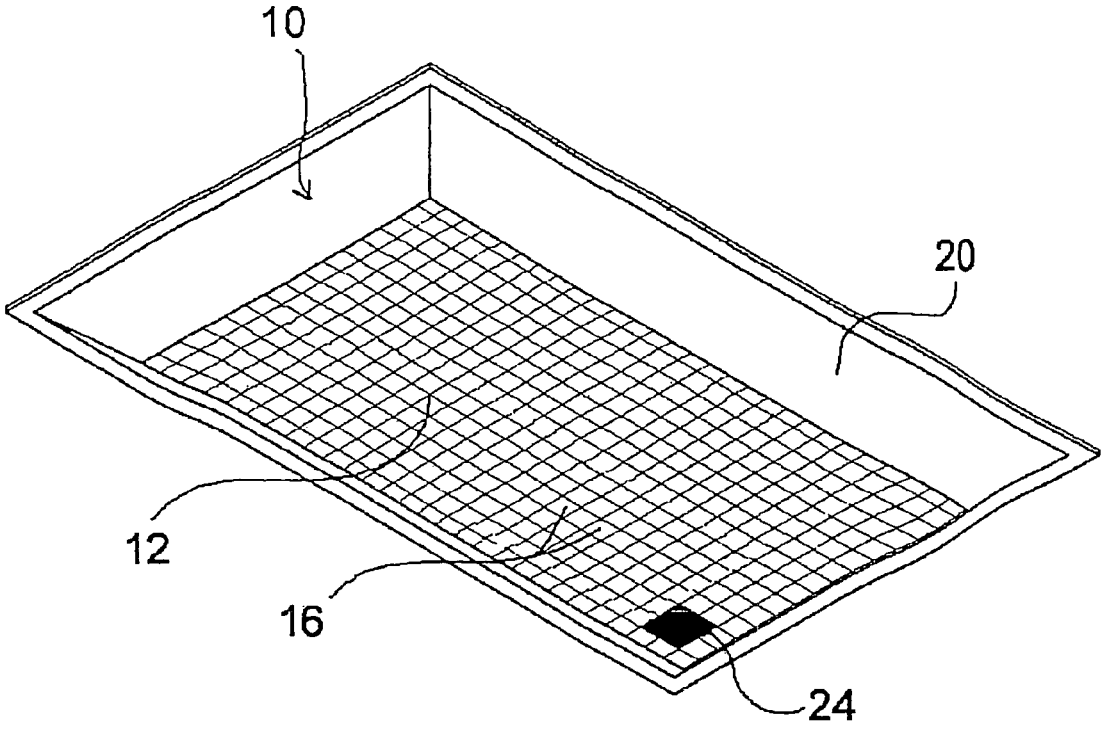
FIG. 3 is a bottom perspective view of the tile of FIG. 1.

Referring first to FIGS. 1 to 3, a fire fighting apparatus according to one embodiment of the invention is in the form of a ceiling tile comprising a substantially flat panel-like tray 10 having a perforated base 12. The tray is preferably made of a lightweight perforated metal which is strengthened by veluring or creasing, a process known in the art. The tray shown in FIGS. 1 to 3 is made to the same dimensions as a standard ceiling tile, but where the tile is to be used on the outside of a structure, such as under the canopy of the forecourt of a gasoline/petrol service station, it can be constructed to have a greater depth for containing a greater volume of fire retardant material. In general, these tiles can be made in any size or shape to fit or replace any known drop/suspended ceiling tile infrastructure.

The base 12 is lined internally with a membrane 14, such as cellophane or the like, which normally closes the perforations 16 in the base but which ruptures at a predetermined elevated temperature, preferably about 55° C. A dry fire retardant powder 18 of a type which is used in fighting forest fires and is a composition of a monoammonium phosphate and ammonium sulphate is placed on the membrane 14 and fills the tray 10. The powder 18 may also include other materials such as antifreeze or the like for extreme weather conditions. The tray 10 has upwardly divergent sidewalls 20 to allow nesting of empty trays for transport and storage.

In operation, one or more of the ceiling tiles 10 are suspended above the fire hazard or area to be protected from fire with the perforated base 12 being exposed on the underside of the tile. Heat from a fire beneath the tile(s) will raise the temperature of the thin membrane material 14, causing it to rupture. The fire retardant powder 18 will then rain down through the now-open perforations 16 onto the source of the heat or flame and abort the fire. Since the particular fire retardant mentioned above is a food additive, it is non toxic and indeed harmless if swallowed or ingested, and it is friendly to the environment and biodegradable.

The clean-up following the extinguished fire is comparatively simple since the ceiling tile is replaced and the powder is just vacuumed up, allowing electrical or other repairs to be made and day-to-day business allowed to continue on a normal basis.

In order to allow the device to operate in a high-ceiling environment where the flames may not reach the ceiling, such as warehouses, large public buildings, petrol stations and the like, an electric heater 22 is located on the base 12 below the membrane 14 and connected to a source of power (not shown) which may be batteries or the mains. The heater 22 is controlled by a smoke detector 24 which is exposed through the base 12 to the atmosphere. The arrangement is such that the heater 22 is normally off, but when the presence of smoke triggers the smoke alarm 24 the latter switches on the heater 22. Heat from the latter now ruptures the membrane 14 so that the fire retardant powder 18 is released as before.

The heater 22 is preferably of the elongated coil type and is separated by insulators from any metal surroundings.

However, electric heater elements of the kind used in cooking ovens, electric hobs, hot water heaters, space heaters, etc. could alternatively be used.

Although perhaps not so useful in naturally smoky environments such as night clubs, the device incorporating the electric heater 22 and smoke detector 24 would be of importance in the areas of petrochemical manufacture and distribution, cruise ships, high rise office buildings, etc., where smoking is banned.

One possible disadvantage of the above embodiment in some situations is that it is "one-shot", i.e. all the powder 18 is discharged upon rupture of the membrane 14. Thus, if the fire should re-ignite as sometimes occurs, or if the fire is not put out by the initial discharge of powder, no further powder is available to put out the flames. This disadvantage is overcome by the embodiment shown in FIG. 4.

Figure 4:
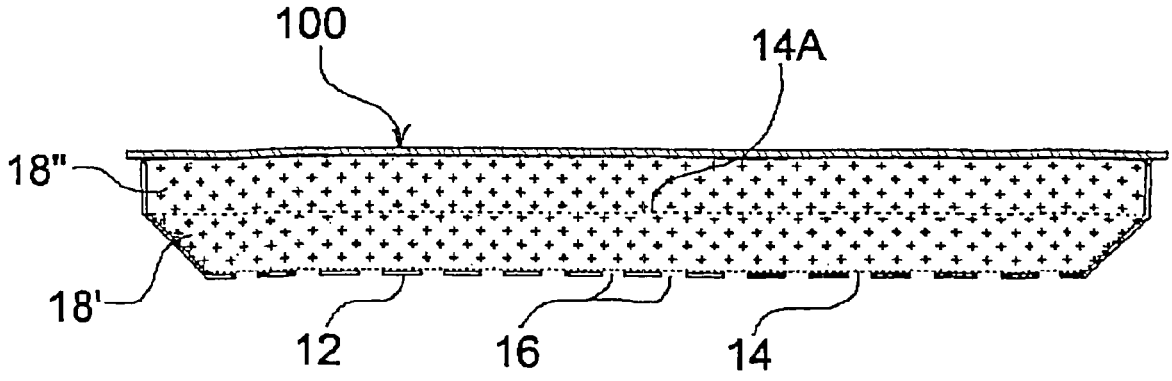
FIG. 4 is a cross-sectional side view of a second ceiling tile embodying the invention.

In the FIG. 4 embodiment, the tray 100 has a greater depth than the tray 10. A second heat-rupturable membrane 14A, similar to the membrane 14, is embedded in the fire retardant powder 18 above the first membrane 14 such that a respective layer 18', 18" of the powder 18 lies above each membrane 14, 14A. Now, upon rupture of the first membrane 14 only the layer 18' of fire retardant powder immediately above it is released, so that the second membrane 14A comes to rest upon the base 12 through the action of gravity on the layer of powder 18". Thus the membrane 14A now takes the place of the first membrane 14 and the second layer of powder 18" is available for release should this second membrane 14A be ruptured.

Of course, more than two heat-rupturable membranes 14, 14A can be used, each separated from its overlying neighbour by a respective layer of the powder 18, so that multiple layers of powder are successively discharged as their supporting membranes are ruptured, until the fire is brought under control. Multiple layering would be especially effective in situations where petrochemical or gas or oil is on fire, since it would minimise the effect of the fire until the fuel feeding the fire is shut off. The embodiment shown in FIG. 4 may also include an electric heater and smoke detector arranged as described for FIGS. 1 to 3 to rupture the lower membrane 14 and, if necessary, each successive membrane.

In general, the suspendible container containing the fire retardant material can be any shape or size to suit the situation sought to be protected. It can be a strictly utilitarian item, such as the ceiling tile described, or it may have a decorative, novelty or ornamental function. Although a single membrane 14 covering all the perforations 16 has been described, the perforations may be individually closed off.

The apparatus could also be made small enough to fit inside the housing of an item of electrical equipment, for example in the roof of a television set or inside an electrical junction box.

The invention is not limited to the embodiments described herein which may be modified or varied without departing from the scope of the invention.

The invention claimed is:

1. An apparatus for fighting a fire comprising a suspendible container having a perforated lower surface each of whose perforations is closed by a heat-sensitive membrane rupturable at an elevated temperature, the container containing a fire retardant material which is released upon rupture of the membrane, the apparatus further including an electric heater adjacent to the membrane and a smoke detector controlling the heater such that upon the detection of smoke the heater is switched on to rupture the membrane.

2. An apparatus as claimed in claim 1, wherein the perforations are closed by a common membrane lining the said lower surface of the container.

3. An apparatus as claimed in claim 1, wherein the container is in the form of a tray having a perforated base.

4. An apparatus as claimed in claim 1, wherein the elevated temperature is approximately 55 deg. C.

5. An apparatus as claimed in claim 1, wherein the fire retardant material is a powder.

6. An apparatus for fighting a fire comprising a suspendible container having a perforated lower surface each of whose perforations is closed by a first heat-sensitive membrane rupturable at an elevated temperature, an electric heater being adjacent to the first membrane and a smoke detector controlling the heater such that upon the detection of smoke, the heater is switched on to rupture the first membrane, the container containing a fire retardant material which is released upon rupture of the membrane, the apparatus further including at least one further heat-sensitive membrane embedded in the fire retardant material above the first membrane such that a respective layer of fire retardant material lies above each membrane, whereby upon rupture of the first membrane the layer of fire retardant material immediately above it is released and the further membrane comes to rest upon the lower surface of the container, the layer of fire retardant material immediately above the further membrane being released only upon subsequent rupture of the further membrane.

7. An apparatus as claimed in claim 6, wherein the container is in the form of a tray having a perforated base.

8. An apparatus as claimed in claim 6, wherein the elevated temperature is approximately 55 deg. C.

9. An apparatus as claimed in claim 1, wherein the fire retardant material is a powder.

* * * * *